United States Patent [19]

Perez et al.

[11] 4,264,697

[45] Apr. 28, 1981

[54] IMAGING SYSTEM

[75] Inventors: Steven R. Perez, Pittsford; Alan R. Monahan, East Rochester; Chin H. Lu; Peter F. Erhardt, both of Webster; Eugene F. Young, Henrietta; Christopher J. AuClair, Rochester, all of N.Y.

[73] Assignee: Xerox Corporation, Stamford, Conn.

[21] Appl. No.: 54,123

[22] Filed: Jul. 2, 1979

[51] Int. Cl.[3] ..... G03G 9/00

[52] U.S. Cl. ..... 430/107; 430/108; 430/109; 430/110; 430/111; 430/137

[58] Field of Search ..... 430/527, 528, 110, 111, 430/109, 108, 107, 137; 252/62.54

[56] References Cited

U.S. PATENT DOCUMENTS

| | | | |
|---|---|---|---|
| 3,162,641 | 12/1964 | Acker et al. | 430/110 |
| 3,743,608 | 7/1973 | Habu | 430/527 |
| 3,888,678 | 6/1975 | Bailey | 430/528 |
| 3,893,935 | 7/1975 | Jadwin | 430/110 |
| 3,944,493 | 3/1976 | Jadwin | 430/109 |
| 3,959,404 | 5/1976 | Labana | 430/109 |
| 3,970,571 | 7/1976 | Olson | 430/110 |
| 4,146,494 | 3/1979 | Hectors | 430/107 |

*Primary Examiner*—Mary F. Downey

[57] ABSTRACT

An electrostatographic developer mixture comprising finely-divided positively charging toner particles electrostatically clinging to negatively charging carrier particles. The toner particles comprise a resin, a colorant, and a charge inducing material selected from (1) a long chain hydrazinium compound and (2) an alkyl pyridinium compound. The carrier particles comprise core particles having a coating of fused thermoplastic resin particles wherein the carrier particles are prepared by dry-mixing the core particles with thermoplastic resin particles until the resin particles adhere to the core particles. The mixture of core and resin particles are heated to between 320° F. and 650° F. for between 20 and 120 minutes so that the resin particles melt and fuse to the core particles. The developer mixture is employed to develop electrostatic latent images.

15 Claims, No Drawings

IMAGING SYSTEM

This invention is generally directed to electrostatographic imaging systems, and more specifically, to improved developer mixture compositions and their use in the development of electrostatic latent images.

The electrostatographic process and more specifically the basic xerographic process is well known as documented in numerous prior art references. In these processes toner materials are electrostatically attracted to the latent image areas on the photoconductive insulating surface in proportion to the charge concentration contained thereon. Many processes are known for applying the toner or electroscopic particles to the electrostatic latent image to be developed such as, for example, cascade development described in U.S. Pat. No. 3,618,552; magnetic brush development described in U.S. Pat. Nos. 2,874,063; 3,251,706; and 3,357,402; powder cloud development described in U.S. Pat. No. 2,221,776; and touchdown development described in U.S. Pat. No. 3,116,432.

It may be desirable in some instances in electrophotographic systems and particularly xerographic systems to produce a reverse copy of the original. For example, it may be desired to produce a negative copy from a positive original or a positive copy from a negative original. This is generally referred to in the art as image reversal, and in electrostatic printing such image reversal can be effected by applying to the image a developer powder which is repelled by the charged areas of the image and adheres to the discharged areas. Specifically toners possessing positive charges are found to be very useful and effective in electrophotographic reversal systems and in particular in electrophotographic systems employing organic photoreceptors which in many instances are initially charged negatively rather than positively thus necessitating the need for a positively charged toner. It is important to note that in a dual developer system, that is where carrier and toner are both being employed, that the toner charges positively in comparison to the charge on the carrier which is charged negatively. Most commercial machines use negatively charged toner; thus when the toner and carrier are mixed the toner acquires a negative charge and the carrier a positive charge in relationship to one another, this concept being referred to as the triboelectric relationship of the materials employed. Reversal developers are described in U.S. Pat. No. 2,986,521, these developers being comprised of electroscopic material coated with finely divided colloidal silica.

Carrier materials useful in the development of electrostatic latent images are described in many patents including, for example, U.S. Pat. No. 3,590,000. The type of carrier material to be used depends on many factors such as the type of development used, the quality of the development desired, the type of photoconductive material employed and the like. Generally, the materials used as carrier surfaces or carrier particles or the coating thereon should have a triboelectric value commensurate with the triboelectric value of the toner in order to generate electrostatic adhesion of the toner of the carrier. Carriers should also be selected which are not brittle so as to cause flaking of the surface or particle break-up under the forces exerted on the carrier during recycle as such causes undesirable effects and could, for example, be transferred to the copy surface thereby reducing the quality of the final image.

There have been recent efforts to develop carriers and particularly coatings for carrier particles in order to obtain better development quality and also to obtain a material that can be recycled and does not cause any adverse effects to the photoconductor. However, commercially available carrier materials usually deteriorate rapidly and the triboelectric charging properties thereof have been found to fluctuate widely, especially when changes in relative humidity occur. Thus, such carrier materials are not desirable for use in electrostatographic systems as they can adversely affect the quality of the developed image.

Accordingly, there is a need for a developer mixture and imaging system wherein the toner component charges triboelectrically positively and the carrier component charges triboelectrically negatively which when used in electrostatographic development systems enables the production of high quality images at a very rapid rate over a long period of time.

SUMMARY OF THE INVENTION

It is therefore an object of this invention to provide developer materials which overcome the above-noted deficiencies.

It is a further object of this invention to provide a developer mixture which contains a positively charging toner and a negatively charging carrier material.

A further object of this invention is to provide improved developer materials, especially improved coated carrier materials and improved toner materials, which may be used in electrostatographic development environments where the photoreceptor is negatively charged.

Another object of this invention is to provide developer materials having improved triboelectric characteristics, and greatly increased useful life.

Another object of this invention is the provision of a developer mixture having improved humidity insensitivity and improved particle to particle uniformity and narrow charge distribution.

An additional object of this invention is the provision of electrostatographic developers which have excellent admix charging characteristics and rapid charging rates.

The above objects and others are accomplished by providing electrostatographic developer mixtures comprising finely-divided toner particles containing a charge inducing material selected from the group consisting of a long chain hydrazinium compound and an alkyl pyridinium compound, and carrier particles comprising a core having a coating of fused thermoplastic resin particles. More particularly, the finely-divided toner particles of this invention may comprise a toner resin, pigment or colorant, and as a charge material, long chain hydrazinium compounds of the following formula:

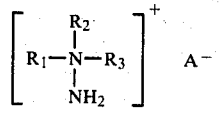

wherein $R_1$ is a hydrocarbon radical containing from about 8 to about 22 carbon atoms, $R_2$ and $R_3$ are independently selected from hydrogen groups or hydrocarbon radicals containing from about 1 to about 22 carbon atoms and A is an anion which in a preferred embodiment is selected from halides such as chloride, bromide, iodide, sulfate, sulphonate, phosphate and nitrate.

Illustrative examples of the $R_1$, $R_2$, and $R_3$ hydrocarbon radicals which radicals can be either aliphatic or aromatic, include for example, methyl, ethyl, propyl, butyl, isobutyl, pentyl, hexyl, heptyl, octyl, nonyl, deceyl, lauryl, myristyl, cetyl, oleoyl, pentadecyl, heptadecyl, octadecyl, benzyl and phenyl.

Illustrative examples of long chain hydrazinium compounds useful in the present invention include, for example, N,N-dimethyl, N-cetyl hydrazinium chloride, N,N-dimethyl N-lauryl hydrazinium bromide, N,N-dimethyl N-cetyl hydrazinium para-toluene sulfonate, N,N-dimethyl N-lauryl hydrazinium chloride, cetyl dimethyl hydrazinium chloride, cetyl dimethyl hydrazinium bromide, N,N-dimethyl N-stearyl hydrazinium para-toluene sulfonate, stearyl methyl benzyl hydrazinium nitrate, and the like. Other compounds not specifically listed herein may also be useful providing they do not adversely affect the system. This listing is not intended to limit the scope of the present invention.

In addition, the charge inducing material may comprise an alkyl pyridinium compound, and its hydrate of the formula

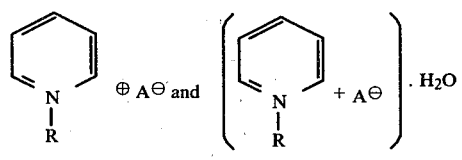

wherein A is an anion which in a preferred embodiment is selected from halides such as chlorine, bromine, iodine, sulfate, sulfonate, nitrate, and borate and R is a hydrocarbon radical containing from about 8 to about 22 carbon atoms and preferably from 12 to 18 carbon atoms. Illustrative examples of the hydrocarbon radicals include octyl, nonyl, deceyl, myristyl, cetyl, oleyl, pentadecyl, heptadecyl and octadecyl.

Illustrative examples of alkyl pyridinium compounds useful in the present invention include cetyl pyridinium chloride, heptadecyl pyridinium bromide, octadecyl pyridinium chloride, myristyl pyridinium chloride, and the like, as well as the corresponding hydrates. Other compounds not specifically listed herein may also be useful providing they do not adversely affect the system.

The amount of charge inducing material used can vary over wide ranges but generally any amount that results in a toner that is charged positively in comparison to the carrier and that develops and electrostatically transfers well is envisioned. For example, the amount of charge inducing material present may range from about 0.1 weight percent to 10 weight percent, and preferably, 0.5 weight percent to 5 weight percent of the total toner weight. The charge inducing material can either be blended into the system or coated on the pigment or colorant such as carbon black when used in the developing compositions. When coated, the charge inducing material is present in about 1 percent to 6 percent by weight of the pigment or colorant, and preferably from about 2 percent to about 4 percent by weight of the pigment.

Numerous methods can be utilized to produce the toner materials of the present invention, one such method involving melt blending the resin and the pigment coated with the charge inducing material followed by mechanical attrition. Other methods include those well known in the art such as spray drying, melt dispersion and dispersion polymerization. For example, a solvent dispersion of resin, pigment, and charge inducing material are spray dried under controlled conditions thereby resulting in the desired product. Such a toner prepared in this manner results in a positive charging toner in relation to the carrier and these toners exhibit the improved properties as mentioned herein. The resultant toner particles are free-flowing and range in size from about 0.1 to about 30 microns. For maximum results, it is preferred that the finely-divided toner particles have an average particle size of from between about 5 microns and up to about 20 microns.

Any suitable thermoplastic resin may be employed as part of the toner composition of the present invention; typical resins including for example, polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenically unsaturated mono-olefins such as ethylene, propylene, butylene and the like; vinyl esters such as vinyl chloride, vinyl bromide, vinyl fluoride, vinyl acetate, vinyl propionate, vinyl benzoate, vinyl butyrate and the like; esters of alpha methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate methyl alpha chloroacrylate methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also, esterification products of a dicarboxylic acid and a diol comprising a diphenol may be used as a preferred resin material for the toner composition of the present invention. These materials are illustrated in U.S. Pat. No. 3,655,374 totally incorporated herein by reference, the diphenol reactant being of the formula as shown in column 4, beginning at line 5 of this patent, and the dicarboxylic acid being of the formula as shown in column 6 of the above patent. The resin is present in an amount so that the total of all ingredients used in the toner total about 100 percent, thus when 5 percent by weight of the charge inducing material is used and 10 percent by weight of the pigment such as carbon black, about 85 percent by weight of resin material is used.

Optimum electrophotographic resins are achieved with styrene butylmethacrylate copolymers, styrene vinyl toluene copolymers, styrene acrylate copolymers, polyester resins, predominantly styrene or polystyrene base resins as generally described in U.S. Pat. No. 25,136 to Carlson and polystyrene blends as described in U.S. Pat. No. 2,788,288 to Rheinfrank and Jones.

Any suitable pigment or dye may be employed as the colorant for the toner particles, such materials being known and including for example, carbon black, magnetite, nigrosine dye, aniline blue, calco oil blue, chrome yellow, ultramarine blue, DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products, Inc. Preferably the pigment is employed in amounts from about 3 percent to about 20 percent by weight based on the total weight of toner, however, if the colorant employed is a dye, substantially smaller quantities of the colorant may be used. When magnetite is employed as the colorant, approximately 20 weight percent to 70 weight percent of the total weight of toner is used. Other pigments that may be useful include, for example, gilsonite, Prussian blue and various iron oxides.

Further, the foregoing toner compositions are employed with novel coated carrier particles. More specifically, the coated carrier particles of this invention are provided by mixing carrier core particles having an average diameter of from between about 30 microns and about 1,000 microns with from between about 0.05 percent and about 3.0 percent by weight, based on the weight of the coated carrier particles, of thermoplastic resin particles having a particle size of between about 0.1 micron and about 30 microns. The foregoing mixture is dry-mixed until the thermoplastic resin particles adhere to the carrier core particles by mechanical impaction and/or electrostatic attraction. The dry mixture is then heated to a temperature of between about 320° F. and about 650° F. for between about 120 minutes and about 20 minutes so that the thermoplastic resin particles melt and fuse to the carrier core particles. After fusion of the resin particles to the carrier core particles, the coated carrier particles are cooled and classified to the desired particle size. The resultant coated carrier particles have a fused resin coating over between about 15 percent and up to about 85 percent of their surface area.

With respect to the amount of thermoplastic resin particles employed, it is preferred that from between about 0.1 percent and about 1.0 percent by weight, based on the weight of the carrier core particles, of the resin particles be mixed with the carrier core particles. In this embodiment, it is preferred that the thermoplastic resin particles have a particle size of between about 0.5 micron and about 10 microns. Likewise, following dry-mixture of these resin particles and the carrier core particles, the mixture is preferably heated to a temperature of between about 400° F. and about 550° F. for between about 90 minutes and about 30 minutes. In this embodiment, the resultant coated carrier particles have a fused resin coating over between about 40 percent and about 60 percent of their surface area. Optimum results have been obtained when the amount of thermoplastic resin particles employed is from between about 0.1 percent and about 0.3 percent by weight, based on the weight of the carrier core particles. In this embodiment, the optimum particle size of the thermoplastic resin particles is between 0.5 micron and 1 micron. Further, the dry mixture is heated to a temperature of between about 480° F. and about 520° F. for between about 70 minutes and about 50 minutes. The resultant carrier particles have a fused resin coating over approximately 50 percent of their surface area.

Any suitable solid material may be employed as the carrier core in this invention. However, it is preferred that the carrier core material be selected so that the coated core material acquire a charge having a polarity opposite to that of the toner particles when brought into close contact therewith so that the toner particles adhere to and surround the carrier particles. In employing the carrier particles of this invention, it is also preferred that the carrier particles be selected so that the toner particles acquire a positive charge and the carrier particles acquire a negative triboelectric charge. Thus, by proper selection of the developer materials in accordance with their triboelectric properties, the polarities of their charge when mixed are such that the electroscopic toner particles adhere to and are coated on the surface of the carrier particles and also adhere to that portion of the electrostatic image-bearing surface having a greater attraction for the toner than the carrier particles.

In accordance with this invention, it is preferred that the carrier core material comprise low density, porous, magnetic or magneically-attractable metal particles having a gritty, oxidized surface and a high surface area, i.e., a surface area which is at least about 200 $cm^2$/gram and up to about 1300 $cm^2$/gram of carrier material. Typical satisfactory carrier core materials include iron, steel, ferrite, magnetite, nickel and mixtures thereof. For ultimate use in an electrostatographic magnetic brush development system, it is preferred that the carrier core materials have an average particle size of between about 30 microns and about 200 microns. Excellent results have been obtained when the carrier core materials comprise porous, sponge iron or steel grit. The carrier core materials are generally produced by gas or water atomization processes or by reduction of suitable sized ore to yield sponge powder particles. The powders produced have a gritty surface, are porous, and have high surface areas. By comparison, conventional carrier core materials usually have a high density and smooth surface characteristics.

It has been found that when attempts are made to apply an insulating resin coating to porous, metallic carrier core materials by solution-coating techniques that the products obtained are undesirable. This is so because most of the coating material is found to reside in the pores of carrier cores and not at the surface thereof so as to be available for triboelectric charging when the coated carrier particles are mixed with finely-divided toner particles. Attempts to resolve this problem by increasing carrier coating weights, for example, to as much as up to about 3 percent or greater to provide an effective triboelectric charging coating to the carrier particles necessarily involves handling excessive quantities of solvents and usually results in low product yields. It has also be found that toner impaction, i.e., where toner particles become welded to or impacted upon the carrier particles, remains high with thus coated carrier particles producing short developer useful lifetimes. Further, solution-coated porous carrier particles when combined and mixed with finely-divided toner particles provide triboelectric charging levels which are too low for practical use. In addition, solution-coated carrier particles have a high incidence of electrical breakdown at low applied voltages leading to shorting between the carrier particles and the photoreceptor. Thus, the powder coating technique of preparing the carrier materials of this invention has been found to be especially effective in coating porous carrier cores to obtain coated carrier particles capable of generating high and useful triboelectric charging values to finely-divided toner particles and carrier particles which possess significantly increased resistivities.

In addition, when resin coated carrier particles are prepared by the powder coating technique, the majority of the coating material particles are fused to the carrier surface and thereby reduce the number of potential toner impaction sites on the carrier material.

The dry, powdered thermoplastic resin particles fused on the carrier materials of this invention may be of any suitable insulating coating material. Typical insulating coating materials include vinyl chloride-vinyl acetate copolymers, styrene-acrylate-organosilicon terpolymers, natural resins such as caoutchouc, carnauba, colophony, copal, dammar, jalap, storax; thermoplastic resins including the polyolefins such as polyethylene, polypropylene, chlorinated poly-ethylene, chlorosulfonated polyethylene, and copolymers and mixtures thereof; polyvinyls and polyvinylidenes such as polystyrene, polymethyl-styrene, polymethyl methacrylate, polyacrylonitrile, polyvinyl acetate, polyvinyl alcohol, polyvinyl butyral, polyvinyl chloride, polyvinyl pyridine, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as as polycaprolactam and polyhexamethylene adipamide; polyesters such as polyethylene terephthalate; polyurethanes; polysulfides, polycarbonates, thermosetting resins including phenolic resins such as phenol-formaldehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow et al in U.S. Pat. No. 3,526,433; and R. J. Hagebach et al in U.S. Pat. Nos. 3,533,835 and 3,658,500. However, it is preferred that the coating material be of the type capable of providing negative triboelectric charging values to the carrier particles wherein the toner particles obtain a positive triboelectric charge for attraction of the toner particles to a negatively charged photoconductive surface. Such carrier coating materials include thermoplastic resins which have been rendered into powder particle form having a particle size of between about 1 and about 100 microns. The preferred powdered coating materials of this invention are selected from fluorinated ethylene, fluorinated propylene and copolymers, mixtures, combinations or derivatives thereof such as fluorinated ethylene-propylene commercially available from E. I. DuPont Company, Wilmington, Delaware, under the tradename FEP; trichlorofluoroethylene, perfluoroalkoxy tetrafluoroethylene, the zinc and sodium salts of ionomer resins such as those containing carboxyl groups which are ionically bonded by partial neutralization with strong bases such as sodium hydroxide and zinc hydroxide to create ionic crosslinks in the intermolecular structure thereof, and polyvinylidene fluoride and the like.

It is also preferred that the powdered coating materials of this invention comprise those which have been prepared by emulsion polymerization techniques because they are available in smaller particle size than those prepared by other polymerization techniques. It is to be noted that most fluoropolymers are not soluble in common solvents; thus, the powder coating technique is especially advantageous when preparing fluoropolymer coated carrier materials for use in electrostatographic devices.

In the initial step of the preparation process of the carrier materials, any suitable means may be employed to apply the coating material powder particles to the surface of the carrier core material. Typical means for this purpose include combining the carrier core material and coating material particles mixture by cascade roll-milling or tumbling, milling, shaking, electrostatic powder cloud spraying, employing a fluidized bed, electrostatic disc processing, and an electrostatic curtain. Following application of the coating material powder particles to the carrier core material, the coated carrier material is heated to permit flow-out of the coating material powder particles over the surface of the carrier core material. As will be appreciated, the concentration of coating material powder particles as well as the conditions of the heating step may be selected as to form a continuous film of the coating material on the surface of the carrier core material or leave selected areas of it uncoated. Where selected areas of the carrier core material remain uncoated or exposed, the carrier material will possess electrically conductive properties when the core material comprises a conductive material. Thus, when such partially polymer coated carrier materials are provided, these carrier materials possess both electrically insulating and electrically conductive properties. Due to the electrically insulating properties of these carrier materials, the carrier materials provide desirably high triboelectric charging values when mixed with finely-divided toner particles. Generally, the toner materials have an average particle diameter of between about 5 and 15 microns. Satisfactory results are obtained when about 1 part by weight toner is used with about 10 to 200 parts by weight of carrier material.

The developer compositions of the instant invention may be employed to develop electrostatic latent images on any suitable electrostatic latent image-bearing surface including conventional photoconductive surfaces. Well known photoconductive materials include vitreous selenium, organic or inorganic photoconductors embedded in a nonphotoconductive matrix, organic or inorganic photoconductors embedded in a photoconductive matrix, or the like. Representative patents in which photoconductive materials are disclosed include U.S. Pat. No. 2,803,542 to Ullrich; U.S. Pat. No. 2,970,906 to Bixby; U.S. Pat. No. 3,121,006 to Middleton; U.S. Pat. No. 3,121,007 to Middleton; and U.S. Pat. No. 3,151,982 to Corrsin.

In the following examples, the relative triboelectric values generated by contact of carrier particles with toner particles is measured by means of a Faraday Cage. The device comprises a steel cylinder having a diameter of about one inch and a length of about one inch. A 400-mesh screen is positioned at each end of the cylinder. The cylinder is weighed, charged with about 0.5 gram mixture of carrier and toner particles and connected to ground through a capacitor and an electrometer connected in parallel. Dry compressed air is then blown through the steel cylinder to drive all the toner from the carrier. The charge on the capacitor is then read on the electrometer. Next, the chamber is reweighed to determine the weight loss. The resulting data is used to calculate the toner concentration and the charge in microcoulombs per gram of toner. Since the triboelectric measurements are relative, the measurements should, for comparative purposes, be conducted under substantially identical conditions.

DESCRIPTION OF PREFERRED EMBODIMENTS

The following examples further define, describe and compare methods of preparing the developer materials of the present invention and of utilizing them to develop electrostatic latent images. Parts and percentages are by weight unless otherwise indicated.

EXAMPLE I

A coated developer mixture was prepared as follows. A toner composition was prepared consisting about 10 percent carbon black commercially available from Cities Service Co. and known as Raven 420, about 0.5 percent of Nigrosine SSB commercially available from American Cyanamid Company, and about 89.5 percent of a 65/35 styrene-n-butyl methacrylate copolymer resin by melt blending followed by mechanical attrition. Three parts by weight of this toner composition was mixed with about 100 parts by weight of carrier particles. The carrier particles comprised about 98.4 parts of sponge iron carrier cores (available from Hoeganaes Corporation, Riverton, New Jersey, under the tradename ANCOR EH 80/150) having an average particle diameter of about 150 microns. A coating coposition comprising about 10 percent solids of polyvinyl chloride and trifluorochloroethylene prepared from a material commercially available as FPC 461 from Firestone Plastics Company, Pottstown, Pa., dissolved in methyl ethyl ketone is applied to the carrier cores as to provide them with a coating weight of about 1.6 percent. The coating composition was applied to the carrier cores via solution coating employing a spray dryer. The developer mixture was placed in a glass jar and roll mixed at a linear speed of about 90 feet per minute for the time indicated in the following Table. The triboelectric charge of the toner was measured by blowing off the toner from the carrier in a Faraday Cage.

| Roll Mixing Time | Toner Tribo μc/g (microcoulombs per gram) |
|---|---|
| 10 min. | 17 |

-continued

| Roll Mixing Time | Toner Tribo μc/g (microcoulombs per gram) |
|---|---|
| 1 hr. | 24 |

From the above results, it is seen that this developer mixture is slow charging in that it is still charging after 1 hour of mixing time.

EXAMPLE II

A developer mixture was prepared as follows. A toner composition was prepared comprising about 6 percent Regal 330 carbon black commercially available from Cabot Corporation, about 0.5 percent of cetyl pyridinium chloride commercially available from Hexcel Company, Lodi, New Jersey, and about 93.5 percent of styrene-n-butyl methacrylate (65/35) copolymer resin by melt blending followed by mechanical attrition. The carrier particles comprised atomized iron carrier cores (available from Hoeganaes Corporation, Riverton, New Jersey, under the tradename ANCOR STEEL 80/150) having an average particle diameter of about 150 microns. The carrier cores were mixed for about 10 minutes with about 0.4 parts of powdered perfluoroalkoxy tetrafluoroethylene having an average particle diameter of about 10 microns. The dry mixture was then heated to a temperature of about 650° F. and held at that temperature for about 20 minutes then rapidly cooled to room temperature by means of a fluidizing bath.

About 97 parts by weight of the coated carrier particles was mixed with about 3 parts by weight of toner particles. The triboelectric charge of the toner after various mixing times as measured in Example I was as follows:

| Roll Mixing Time | Toner Tribo μc/g (microcoulombs per gram) |
|---|---|
| 10 min. | 44 |
| 1 hr. | 35 |

The toner was fast charging against the carrier and the tribo was stable after the long mixing period.

EXAMPLE III

A developer mixture was prepared as follows. A toner composition was prepared comprising about 6 percent Regal 330 carbon black commercially available from Cabot Corporation, about 2 percent of cetyl pyridinium chloride commercially available from Hexcel Company, Lodi, New Jersey, and about 92 percent of styrene-n-butyl methacrylate (65/35) copolymer resin by melt blending followed by mechanical attrition. The carrier particles comprised atomized iron carrier cores (available from Hoeganaes Corporation, Riverton, New Jersey, under the tradename ANCOR STEEL 80/150) having an average particle diameter of about 150 microns. The carrier cores were mixed for about 10 minutes with about 0.4 parts of powdered perfluoroalkoxy tetrafluoroethylene having an average particle diameter of about 10 microns. The dry mixture was then heated to a temperature of about 650° F. and held at that temperature for about 20 minutes then rapidly cooled to room temperature by means of a fluidizing bath.

About 97 parts by weight of the coated carrier particles was mixed with about 3 parts by weight of toner particles. The triboelectric charge of the toner after various mixing times as measured in Example I was as follows:

| Roll Mixing Time | Toner Tribo μc/g (microcoulombs per gram) |
|---|---|
| 10 min. | 38 |
| 1 hr. | 34 |

The toner was fast charging against the carrier and the tribo was stable after the long mixing period.

The developer mixture was employed in an electrostatographic device to develop an electrostatic latent image provided from a negatively charged photoreceptor to obtain prints having a 1.1 solid area density. Print image toner background density was found to be about 0.003 after making about 2,000 copies and the triboelectric charge on the toner material was about 18 microcoulombs per gram of toner material.

EXAMPLE IV

A developer mixture was prepared as follows. The toner composition was that employed in Example III. The carrier particles comprised about 99.85 parts of atomized iron carrier cores (available from Hoeganaes Corporation, Riverton, New Jersey, under the tradename ANCOR STEEL 80/150) having an average particle diameter of about 150 microns and a surface iron oxide content of about 0.7 percent. The carrier cores were mixed for about 10 minutes with about 0.15 parts of powdered polyvinylidene fluoride (available from Pennwalt Corporation, King of Prussia, Pa., under the tradename KYNAR 301F) having an average particle diameter of about 0.35 micron. The dry mixture was then heated to a temperature of about 510° F. for about 60 minutes and cooled to room temperature.

About 97 parts by weight of the coated carrier particles was mixed with about 3 parts by weight of the toner particles. The triboelectric charge of the toner after various mixing times as measured in Example I was as follows:

| Roll Mixing Time | Toner Tribo μc/g (microcoulombs per gram) |
|---|---|
| 10 min. | 58 |
| 1 hr. | 45 |
| 3 hr. | 33 |
| 5 hr. | 26 |

The toner was fast charging against this carrier and tribo was stable after long mixing times.

The developer mixture was employed in an electrostatographic device to develop an electrostatic latent image provided from a negatively charged photoreceptor to obtain prints having a 1.1 solid area density. Print image toner background density was found to be about 0.003 after making about 2,000 copies and the triboelectric charge on the toner material was about 29 microcoulombs per gram of toner material.

A fresh sample of developer mixture was aged for about 24 hours by exposure to an atmosphere having a temperature of about 23° C. and 20%, and 80% relative humidity, respectively. The developer mixture was then roll-mixed in a glass jar at a linear speed of about 90 feet per minute for about 4 hours. The triboelectric charge of the toner was then measured and triboelectric products calculated. The triboelectric product is the value obtained by multiplying the triboelectric charge in microcoulombs per gram of toner by the toner concentration. The triboelectric product of the sample aged at 20% relative humidity was about 123 and of the sample aged at 80% relative humidity was about 111. The percentage decrease in triboelectric product between the developer mixture aged at 20% relative humidity and that aged at 80% humidity was only about 10% resulting in a humidity insensitive developer material.

EXAMPLE V

A developer mixture was prepared as follows. A toner composition was prepared comprising about 6 percent Regal 330 carbon black, about 1.5 percent cetyl pyridinium chloride, and about 92.5 percent styrene-n-butyl methacrylate 65/35 copolymer by melt blending followed by mechanical attrition. The toner was classified to remove particles having diameters below 5 microns. The carrier particles comprised about 98.4 parts of sponge iron carrier cores (available from Hoeganaes Corporation, Riverton, New Jersey, under the tradename ANCOR EH 80/150) having an average particle diameter of about 150 microns. A coating composition comprising about 10 percent solids of polyvinyl chloride and trifluorochloroethylene prepared from a material commercially available as FPC 461 from Firestone Plastics Company, Pottstown, Pa., dissolved in methyl ethyl ketone is applied to the carrier cores as to provide them with a coating weight of about 1.6 percent. The coating composition was applied to the carrier cores via solution coating employing a vibratub (available from Vibraslide, Inc., Binghamton, New York).

About 97 parts by weight of the coated carrier particles was mixed with about 3 parts by weight of the toner particles having an average diameter of about 12 microns. The triboelectric charge of the toner after various mixing times as measured in Example I was as follows:

| Roll Mixing Time | Toner Tribo μc/g (microcoulombs per gram) |
|---|---|
| 10 min. | 26 |
| 1 hr. | 20 |

The toner was fast charging against this carrier and tribo was stable after the long mixing time. The developer was tested in a fixture using a photoreceptor charged negatively. Prints of excellent quality and low background were obtained.

The developer mixture was employed in an electrostatographic device to develop an electrostatic latent image provided from a negatively charged photoreceptor to obtain prints having a 1.1 solid area density. Print image toner background density was found to be about 0.002 after making about 2,000 copies and the triboelectric charge on the toner material was about 22 microcoulombs per gram of toner material.

EXAMPLE VI

A developer mixture was prepared as follows. A toner composition was prepared comprising about 6 percent Regal 330 carbon black, about 1 percent of cetyl pyridinium chloride, and about 93 percent styrene-n-butyl methacrylate 65/35 copolymer resin by melt blending followed by mechanical attrition. The carrier particles employed were essentially the same as those of Example III. About 97 parts of the carrier particles was mixed with about 3 parts of the toner particles. The triboelectric charge of the toner after various mixing times as measured in Example I was as follows:

| Roll Mixing Time | Toner Tribo μc/gram (microcoulombs per gram) |
|---|---|
| 10 min. | 42 |
| 1 hr. | 35 |

The toner was fast charging against the carrier and the tribo was stable.

EXAMPLE VII

A developer mixture was prepared as follows. A toner composition was prepared comprising about 10 percent Raven 420 carbon black, about 3 percent of cetyl pyridinium chloride, and about 87 percent styrene-n-butyl methacrylate 65/35 copolymer resin by melt blending followed by mechanical attrition. The carrier particles comprised about 99.85 parts of atomized iron carrier cores (available from Hoeganaes Corporation, Riverton, New Jersey, under the tradename ANCOR STEEL 80/150) having an average particle diameter of about 150 microns and a surface iron oxide content of about 0.6%. The carrier cores were mixed for about 10 minutes with about 0.15 parts of powdered polyvinylidene fluoride (available from Pennwalt Corporation, King of Prussia, Pa., under the tradename Kynar 201) having an average particle diameter of about 0.35 micron. The dry mixture was then heated to a temperature of about 510° F. for about 60 minutes and cooled to room temperature.

About 97 parts of weight of the coated carrier particles was mixed with about 3 parts by weight of the toner particles. The triboelectric charge of the toner after various mixing times as measured in Example I was as follows:

| Roll Mixing Time | Toner Tribo μc/gram (microcoulombs per gram) |
|---|---|
| 10 min. | 35 |
| 1 hr. | 29 |
| 24 hr. | 25 |

The toner was fast charging against the carrier and the tribo was stable.

EXAMPLE VIII

A developer mixture was prepared as follows. A toner composition was prepared comprising about 6 percent by weight of Regal 330 carbon black commercially available from Cabot Corporation, about 92 percent of a 65/35 copolymer resin of styrene-n-butyl methacrylate, and about 2 percent by weight of N,N dimethyl N-cetyl hydrazinium chloride by melt blending followed by mechanical attrition. The toner was classified to remove particles having average diameters below 5 microns, and 3 parts of the classified toner were blended with about 97 parts of the carrier particles of Example VII to form a developer mixture. The developer was used in a device containing a polyvinylcarbazole photoreceptor that was charged negatively, and good quality prints were obtained with high optical density and low background. Admix experiments indicated the developer had very fast charging characteristics and very narrow charge distribution. The carbon black dispersion and particle to particle uniformity were excellent as determined by transmission electron microscope techniques.

The triboelectric charge of the toner was measured by blowing off the toner from the carrier in a Faraday cage as in Example I.

| Roll Mixing Time | Toner Tribo μc/g (microcoulombs per gram) |
|---|---|
| 10 min. | 49 |
| 1 hr. | 47 |

The developer mixture was employed in an electrostatographic device to develop an electrostatic latent image provided from a negatively charged photoreceptor to obtain prints having a 1.1 solid area density. Print image toner background density was found to be about 0.008 after making about 600 copies and the triboelectric charge on the toner material was about 37 microcoulombs per gram of toner material.

EXAMPLE IX

A developer mixture was prepared as follows. A toner composition was prepared comprising about 6 percent by weight of Regal 330 carbon black commercially available from Cabot Corporation, about 92 percent of a 65/35 copolymer resin of styrene-n-butyl methacrylate, and about 2 percent by weight of N,N dimethyl N-cetyl hydrazinium paratoluene sulphonate by melt blending followed by mechanical attrition. The toner was classified to remove particles having average diameters below 5 microns, and 3 parts of the classified toner were blended with about 97 parts of the carrier particles of Example IV to form a developer mixture. The developer was used in a device containing a polyvinylcarbazole photoreceptor that was charged negatively, and good quality prints were obtained with high optical density and low background. Admix experiments indicated the developer had very fast charging characteristics and very narrow charge distribution. The carbon black dispersion and particle to particle uniformity were excellent as determined by transmission electron microscope techniques.

The triboelectric charge of the toner was measured by blowing off the toner from the carrier in a Faraday cage as in Example I.

| Roll Mixing Time | Toner Tribo μc/g (microcoulombs per gram) |
|---|---|
| 10 min. | 43 |
| 1 hr. | 37 |

EXAMPLE X

A toner comprised of about 10 percent Raven 420 carbon black commercially available from Cities Service Co., about 2 percent N,N-dimethyl N-lauryl hydrazinium bromide, and about 88 percent of a 65/35 copolymer resin of styrene-n-butyl methacrylate was prepared by melt blending followed by mechanical attrition. The toner was classified to remove particles having a diameter of less than 5 microns. Three parts of the resulting classified toner and about 100 parts of the carrier of Example III were blended into a developer. The developer was tested in a device as described in Example I. Good quality prints of high solid area density and very low background density were obtained.

EXAMPLE XI

A developer mixture was prepared as follows. A toner composition was prepared comprising about 6 percent Regal 330 carbon black commercially available from Cabot Corporation, about 2 percent of cetyl pyridinium bromide commercially available from Hexcel Company, Lodi, New Jersey, and about 92 percent of styrene-n-butyl methacrylate (65/35) copolymer resin by melt blending followed by mechanical attrition. The carrier particles comprised about 99.85 parts of atomized iron carrier cores (available from Hoeganaes Corporation, Riverton, New Jersey, under the tradename ANCOR STEEL 80/150) having an average particle diameter of about 150 microns. The carrier cores were mixed for about 10 minutes with about 0.15 parts of powdered polyvinyidene fluoride (available from Pennwalt Corporation, King of Prussia, Pa., under the tradename KYNAR 201) having an average particle diameter of about 0.35 micron. The dry mixture was then heated to a temperature of about 510° F. and held at that temperature for about 60 minutes then cooled to room temperature.

About 97 parts by weight of the coated carrier particles was mixed with about 3 parts by weight of toner particles. The triboelectric charge of the toner after various mixing times as measured in Example I was as follows:

| Roll Mixing Time | Toner Tribo μ/g (microcoulombs per gram) |
|---|---|
| 10 min. | 41 |
| 1 hr. | 35 |

The toner was fast charging against the carrier and the tribo was stable after the long mixing period. The toner also had a narrow charge distribution. The developer mixture was tested in a fixture using a negatively charged photoreceptor. Excellent prints of high solid area density and low background density were obtained.

A fresh sample of developer mixture was aged for about 24 hours by exposure to an atmosphere having a temperature of about 23° C. and 20%, and 80% relative humidity, respectively. The developer mixture was then roll-mixed in a glass jar at a linear speed of about 90 feet per minute for about 4 hours. The triboelectric charge of the toner was then measured and triboelectric products calculated. The triboelectric product is the value obtained by multiplying the triboelectric charge in microcoulombs per gram of toner by the toner concentration. The triboelectric product of the sample aged at 20% relative humidity was about 116 and of the sample aged at 80% relative humidity was about 99. The percentage decrease in triboelectric product between the developer mixture aged at 20% relative humdity and that aged at 80% relative humidity was only about 15% resulting in a humidity insensitive developer material.

EXAMPLE XII

A develper mixture was prepared as follows. A toner composition was prepared comprising about 6 percent Regal 330 carbon black, about 2 percent cetyl pyridinium chloride, and about 92 percent styrene-n-butyl methacrylate 53/42 copolymer by melt blending followed by mechanical attrition. The toner was classified to remove particles having diameters below 5 microns.

About 97 parts by weight of the carrier particles of Example IV was mixed with about 3 parts by weight of the toner particles having an average diameter of about 12 microns. The triboelectric charge of the toner after various mixing times as measured in Example I was as follows:

| Roll Mixing Time | Toner Tribo μc/g (microcoulombs per gram) |
|---|---|
| 10 min. | 50 |
| 1 hr. | 46 |

The toner was fast charging against this carrier and tribo was stable after the long mixing time. The developer was tested in a fixture using a photoreceptor charged negatively. Prints of excellent quality and low background were obtained.

Although specific materials and conditions are set forth in the foregoing examples, these are merely intended as illustrations of the present invention. Various other suitable thermoplastic toner resin components, additives, colorants, and developmen processes such as those listed above may be substituted for those in the examples with similar results. Other materials may also be added to the toner or carrier to sensitize, synergize or otherwise improve the fusing properties or other desirable properties of the system.

Other modifications of the present invention will occur to those skilled in the art upon a reading of the present disclosure. These are intended to be included within the scope of this invention.

What is claimed is:

1. An electrostatographic developer mixture comprising finely-divided, postively charging toner particles electrostatically clinging to negatively charging carrier particles having an average diameter of from between about 30 microns and about 1,000 microns, said toner particles comprising a resin, a colorant, and a charge inducing material comprising a long chain hydrazinium compound of the formula:

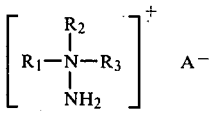

wherein $R_1$ is a hydrocarbon radical containing from 8 to 22 carbon atoms, $R_2$ and $R_3$ are independently selected from hydrogen or hydrocarbon radicals containing from 1 to 22 carbon atoms and A is an anion which is selected from halides, sulfate, sulphonate, phosphate and nitrate; said carrier particles comprising core particles having a coating of fused thermoplastic resin particles wherein said carrier particles are prepared by mixing said core particles with thermoplastic resin particles in an amount of from between about 0.05 percent and about 3.0 percent by weight based on the weight of said core particles, dry-mixing said core particles and said thermoplastic resin particles until said thermoplastic resin particles adhere to said core particles by mechanical impaction or electrostatic attraction, heating the mixture of core particles and thermoplastic resin particles to a temperature of between about 320° F. and about 650° F. for between about 120 minutes and about 20 minutes so that said thermoplastic resin particles melt and fuse to said core particles, and cooling the coated carrier particles.

2. An electrostatographic developer mixture in accordance wih claim 1 wherein said charge inducing material is a long chain hydrazinium compound wherein $R_1$ is cetyl, $R_2$ and $R_3$ are methyl and A is chloride.

3. An electrostatographic developer mixture in accordance with claim 1 wherein said long chain hydrazinium compound is N,N-dimethyl N-cetyl hydrazinium chloride.

4. An electrostatographic developer mixture in accordance with claim 1 wherein said long chain hydrazinium compound is N,N-dimethyl N-lauryl hydrazinium chloride.

5. An electrostatographic developer mixture in accordance with claim 1 wherein long chain hydrazinium compound is N,N-dimethyl N-cetyl hydrazinium paratoluene sulfonate.

6. An electrostatographic developer mixture in accordance with claim 1 wherein said long chain hydrazinium compound is N,N-dimethyl N-lauryl hydrazinium bromide.

7. An electrostatographic developer mixture in accordance with claim 1 wherein said resin is a copolymer of a styrene-n-butyl methacrylate, said colorant is carbon black, and said long chain hydrazinium compound is N,N-dimethyl N-cetyl hydrazinium chloride.

8. An electrostatographic developer mixture in accordance with claim 1 wherein said colorant is coated with said long chain hydrazinium compound in an amount of from 1 percent to 6 percent by weight based on the weight of the colorant.

9. An electrostatographic developer mixture comprising finely-divided, positively charging toner particles electrostatically clinging to negatively charging carrier particles having an average diameter of from between about 30 microns and about 1,000 microns, said toner particles comprising a resin, a colorant, and a charge inducing material, comprising an alkyl pyridinium compound and its hydrate of the formula:

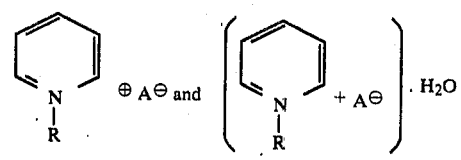

wherein R is a hydrocarbon radical containing from about 8 to about 22 carbon atoms, and A is an anion; said carrier particles comprising core particles having a coating of fused thermoplastic resin particles wherein said carrier particles are prepared by mixing said core particles with thermoplastic resin particles in an amount of from between about 0.05 percent and about 3.0 percent by weight based on the weight of said core particles, dry-mixing said core particles and said thermoplastic resin particles until said thermoplastic resin particles adhere to said core particles by mechanical impaction or electrostatic attraction, heating the mixture of core particles and thermoplastic resin particles to a temperature of between about 320° F. and about 650° F. for between about 120 minutes and about 20 minutes so that said thermoplastic resin particles melt and fuse to said core particles, and cooling the coated carrier particles.

10. An electrostatographic developer mixture in accordance with claim 9 wherein said alkyl pyridinium compound is cetyl pyridinium chloride.

11. An electrostatographic developer mixture in accordance with claim 9 wherein said charge inducing material is an alkyl pyridinium compound wherein said anion is selected from halides, sulfates, sulfonates, nitrates and borates, and R is a hydrocarbon radical of 12 to 18 carbon atoms.

12. An electrostatographic developer mixture in accordance with claim 9 wherein said carrier particles have said fused coating of said thermoplastic resin particles over between about 15 percent and about 85 percent of their surface area.

13. An electrostatographic developer mixture in accordance with claim 9 wherein said core particles comprise low density, porous, magnetic or magnetically attractable metal particles having a gritty, oxidized surface and a surface area of at least about 200cm$^2$/gram and up to about 1300 cm$^2$/gram.

14. An electrostatographic developer mixture in accordance with claim 9 wherein said core particles are selected from the group consisting of iron, steel, ferrite, magnetite, nickel, and mixtures thereof.

15. An electrostatographic developer mixture in accordance with claim 9 wherein said thermoplastic resin particles are selected from the group consisting of fluorinated ethylene, fluorinated propylene, fluorinated ethylene-propylene, trichlorofluoroethylene, perfluoroalkoxy tetrafluoroethylene, polyvinylidene fluoride, polyvinyl chloride, trifluorochloroethylene, and derivatives thereof.

* * * * *